United States Patent [19]

Landers

[11] 4,124,988

[45] Nov. 14, 1978

[54] SEAL ASSEMBLY FOR HOLLOW TUBULAR STRUCTURE

[75] Inventor: Don B. Landers, Arlington, Tex.

[73] Assignee: Oil States Rubber Co., Arlington, Tex.

[21] Appl. No.: 733,249

[22] Filed: Oct. 18, 1976

Related U.S. Application Data

[63] Continuation of Ser. No. 574,920, May 6, 1975, abandoned.

[51] Int. Cl.[2] ..... E02D 5/00

[52] U.S. Cl. ..... 405/228

[58] Field of Search ..... 61/53, 86, 87, 98, 94; 138/89, 96 R, 96 T; 277/237

[56] References Cited

U.S. PATENT DOCUMENTS

| | | | |
|---|---|---|---|
| 3,074,579 | 1/1963 | Miller | 138/96 T |
| 3,228,334 | 1/1966 | Oss | 138/96 R X |
| 3,305,120 | 2/1967 | Owen | 138/96 R X |
| 3,474,630 | 10/1969 | Pogonowski | 61/86 |
| 3,533,241 | 10/1970 | Bowerman et al. | 61/86 |
| 3,570,259 | 3/1971 | Thaxton | 61/94 X |
| 3,702,537 | 11/1972 | Landers | 61/98 |
| 3,814,135 | 6/1974 | Hetzer et al. | 138/89 |

*Primary Examiner*—Mervin Stein
*Assistant Examiner*—David H. Corbin
*Attorney, Agent, or Firm*—Warren H. Kintzinger

[57] ABSTRACT

An annular built up seal section on a diaphragm used for closing the end of a large tube with the annular built up seal section sized for sealing engagement with the tube end.

2 Claims, 4 Drawing Figures

SEAL ASSEMBLY FOR HOLLOW TUBULAR STRUCTURE

Figure 1:
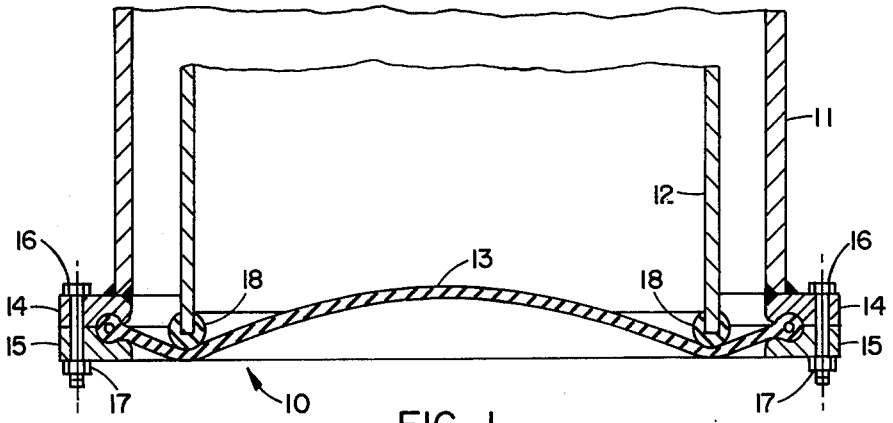

This is a continuation of application Ser. No. 574,920, filed May 5, 1975, now abandoned.

This invention relates to seal assemblies utilizing diaphragms and, more particularly, a built up seal on a diaphragm providing an effective seal bond between a hollow tubular member and the diaphragm.

In recent years, the installation of marine drilling platforms and similar offshore structures has been simplified by the use of rupturable seal assemblies for the piling guides. Such assemblies are disclosed in U.S. Pat. No. 3,533,241, issued Oct. 13, 1970, and assigned to the assignee of this invention, the disclosure of which is hereby incorporated by reference herein. These seal assemblies generally close the lower ends of the upright tubular legs, or piling guides, of the marine drilling platforms. The diaphragms are flexible and to some degree elastic and are made typically of nylon-corded rubber. A holding member secures the diaphragms to the outer piling guide to seal the inside of the piling so it can be a floodably controlled float element of a structure and to also seal from the external environment. Internal to the piling guide is, typically, a hollow piling, with it being desirable to also seal the interior of the piling from the annular space formed between the piling and piling guide. This has been accomplished by installing a bead of elastomer on the end of the piling and keeping the piling in engagement with the diaphragm to form a seal. This prior method has proven not be be too reliable since the bead has a tendency to roll off the piling whenever the piling experiences lateral motion with respect to the piling guide.

It is therefore a principal object of this invention to provide a diaphragm seal assembly with a built up seal for more surely closing the end of a hollow tubular member.

Another object is to provide a seal assembly sealing the interior of an inside tubular member from the annular space between the inside tubular member and an outside tubular member.

Features of this invention useful in accomplishing the above objects include an annular pad of elastomer material bonded to a diaphragm against which the end of a hollow, tubular member is placed in contact.

Specific embodiments representing what are presently regarded as the best modes of carrying out the invention are illustrated in the accompanying drawing.

Figure 2:
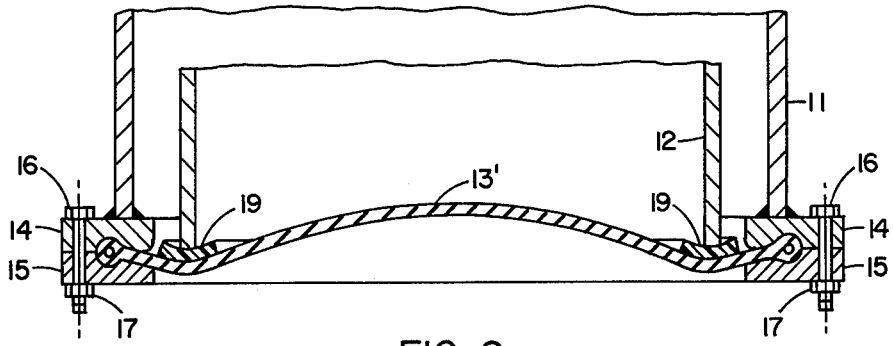
Figure 3:
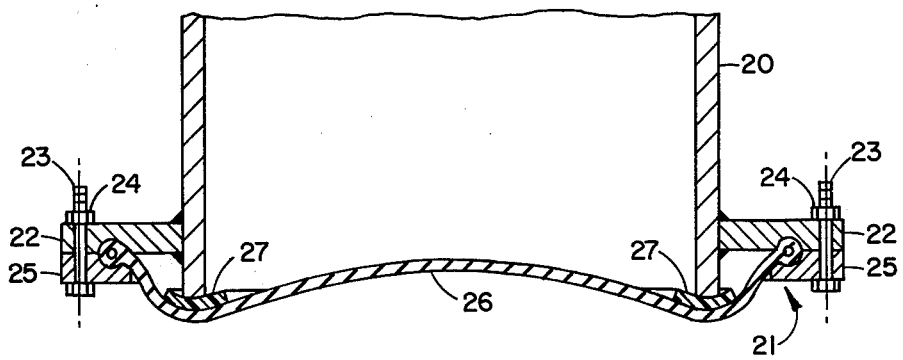
Figure 4:
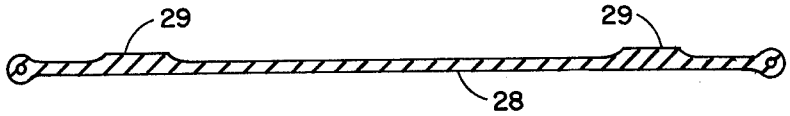

In the drawing:

FIG. 1 represents a sectional view of a prior art diaphragm seal assembly including a bead for sealing the annular space between interior and exterior tubular members;

FIG. 2, a sectional view of an improved diaphragm seal assembly constructed in accordance with the principles of this invention;

FIG. 3, a sectional view of a diaphragm seal assembly for use with a single hollow tubular member, and constructed in accordance with the principles of this invention; and FIG. 4, a sectional view of another embodiment of a diaphragm incorporating principles of this invention.

Referring to the drawing:

Seal assembly 10 is shown mounted on the lower end of a hollow tubular piling guide 11 enclosing hollow tubular piling 12. Included as part of assembly 10 is flexible diaphragm 13 and annular flange members 14 and 15. Annular flange member 14, that is shown as being welded to the end of piling guide 11, has secured thereto by means of bolts 16 and nuts 17 an annular flange member 15. The annular flange members 14 and 15 include complementary annular grooves therein adapted to receive and secure the thickened peripheral portion of diaphragm 13, just as described in the aforementioned patent. In accordance with the teachings of the prior art, in order to maintain a seal between the interior of piling 12 and the annular space between piling 12 and piling guide 11, an annular bead 18 of elastomer material is adhesively secured to the end of piling 12. Piling 12 is then brought into contact, through bead 18, with diaphragm 13 and a pressure differential between the exterior and the interior of piling 12 helps create a seal between bead 18 and diaphragm 13. Frequently, however, relative lateral motion between piling 12 and piling guide 11 occurs. It has been found when using the bead 18 as a seal element, piling 12 has a tendency to roll off bead 18, thereby destroying the desired seal.

FIG. 2 shows a piling guide 11, piling 12, and diaphragm assembly 13' in combination with an improved seal 19 according to this invention. Instead of a bead seal as shown in FIG. 1, an annular pad seal 19 of elastomer material such as urethane rubber is bonded to the side of diaphragm 13 that is internal to piling guide 11. After piling 12 is placed in contact with pad seal 19, a pressure differential external to internal developed by means not shown, helps seal piling 12 to pad 19. This improved seal remains effective despite design permitted relative lateral motion between piling 12 and guide 11. Further, it is more advantageous for a pad seal 19 to be bonded, adhesively, to diaphragm 13', than it is to bond the bead seal 18 of FIG. 1 to piling 12.

The improved pad seal of this invention may also be utilized to effectively seal a single hollow tubular member such as shown in FIG. 3. Tubular member 20 is capped by seal assembly 21 including annular flange member 22, welded to the outside of the end of tubular member 20, annular flange member 25 secured to flange member 22 by bolts 23 and nuts 24, and diaphragm 26. Flange members 22 and 25 have annular grooves therein adapted to receive and hold the thickened peripheral portion of diaphragm 26, constructed as described in the aforementioned patent. Annular pad seal 27, constructed of an elastomer material such as urethane rubber, is bonded to the upper side of diaphragm 26. Thus, an effective seal and diaphragm structure is provided capable of establishing a secure barrier between the inside of tubular member 20 and the outside environment.

With the diaphragm 28 of FIG. 4, raised annular pad 29 is mold formed as an integral flexible compressible part thereof. This diaphragm may be utilized as an alternative to the diaphragm and seal pad structure of FIGS. 2 and 3, having the annular pads bonded thereto.

Whereas this invention is herein illustrated and described with respect to particular embodiments thereof, it should be realized that changes may be made without departing from the essential contributions to the art made by the teachings hereof.

I claim:

1. In combination with a water immersible hollow tubular structure such as an underwater piling guide and the like a seal assembly comprising, inner and outer concentric hollow tubular members; a circular elastic diaphragm, clamping means attached to said outer tubular member for holding said diaphragm to cover and seal an end of said outer tubular member from environment external of said outer tubular member; an annular pad of elastomer material attached to a face of said diaphragm and positioned radially inwardly from the perimeter of said outer tubular member, and in alignment with the wall end of said inner tubular member; said diaphragm comprising a flexible elastic sheet of rubber-like material of a type substantially flexed and distorted by application of different fluid pressures to respective opposite faces thereof upon immersion in water; and said diaphragm being responsive solely to a fluid pressure exerted on the inner tubular member facing surface thereof being less than a fluid pressure exerted on the external environment water facing surface thereof to urge said annular pad into sealing engagement with said wall end of said inner tubular member.

2. In combination with a water immersible hollow tubular structure a sealing assembly; comprising a hollow tubular member; a circular elastic diaphragm with a thickened peripheral portion; holding means attached to the outside of said tubular member at a position radially outwardly and downwardly displaced from the wall end of said tubular member, said holding means receiving the thickened peripheral portion of said diaphragm and holding said diaphragm over the wall end of said tubular member; an annular pad of elastomer material attached to the tubular member wall end facing side of said diaphragm and positioned radially inwardly from said thickened peripheral portion so as to address the wall end of said tubular member; said diaphragm comprising a flexible elastic sheet of rubber-like material of a type substantially flexed and distorted by application of different fluid pressures to respective opposite faces thereof upon immersion in water; and said diaphragm being responsive solely to a fluid pressure exerted on the tubular member wall end facing surface thereof being less than a fluid pressure exerted on the external environment water facing surface thereof to urge said annular pad into sealing engagement with the wall end of said tubular member.

* * * * *